US007672605B2

(12) United States Patent
Kayahara et al.

(10) Patent No.: US 7,672,605 B2
(45) Date of Patent: Mar. 2, 2010

(54) TRANSFER DEVICE AND IMAGE FORMING APPARATUS

(75) Inventors: Shin Kayahara, Kanagawa (JP); Yoshiyuki Kimura, Tokyo (JP); Eisaku Murakami, Tokyo (JP); Masahiko Satoh, Tokyo (JP); Masanori Kawasumi, Kanagawa (JP); Hideki Zemba, Kanagawa (JP); Takeshi Uchitani, Kanagawa (JP); Eiji Shimojo, Tokyo (JP); Shunichi Hashimoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 96 days.

(21) Appl. No.: 11/758,840

(22) Filed: Jun. 6, 2007

(65) Prior Publication Data

US 2007/0286628 A1 Dec. 13, 2007

(30) Foreign Application Priority Data

Jun. 8, 2006 (JP) ..... 2006/160212

(51) Int. Cl.
*G03G 15/16* (2006.01)

(52) U.S. Cl. ..... 399/66; 399/299; 399/302; 399/303; 399/318

(58) Field of Classification Search ..... 399/66, 399/299, 302, 303, 318, 331, 339
See application file for complete search history.

(56) References Cited

U.S. PATENT DOCUMENTS

| | | | |
|---|---|---|---|
| 5,640,645 | A | 6/1997 | Namekata et al. |
| 6,061,543 | A | 5/2000 | Kayahara et al. |
| 6,212,351 | B1 | 4/2001 | Kawagoe et al. |
| 6,269,228 | B1 | 7/2001 | Kayahara et al. |
| 6,505,024 | B2 | 1/2003 | Kayahara et al. |
| 6,654,574 | B2 | 11/2003 | Kayahara et al. |
| 6,697,595 | B2 | 2/2004 | Kawagoe et al. |
| 6,701,118 | B2 | 3/2004 | Kayahara et al. |
| 6,778,794 | B2 | 8/2004 | Kayahara |
| 6,901,234 | B2 | 5/2005 | Ogiyama et al. |

(Continued)

FOREIGN PATENT DOCUMENTS

| | | |
|---|---|---|
| JP | 9-146383 | 6/1997 |

(Continued)

OTHER PUBLICATIONS

U.S. Appl. No. 12/144,078, filed Jun. 23, 2008, Kayahara et al.

(Continued)

*Primary Examiner*—Sandra L O'Shea
*Assistant Examiner*—Evan Dzierzynski
(74) *Attorney, Agent, or Firm*—Oblon, Spivak, McClelland, Maier & Neustadt, L.L.P.

(57) ABSTRACT

A transfer device is provided for an image forming apparatus designed such that toner images formed on a plurality of image bearing members are transferred one over another on a transfer body disposed in contact with each of the image bearing members with predetermined pressure and thus a toner image in two or more colors is formed on the transfer body. The transfer device includes a pressure varying mechanism which is capable of separating the transfer body from at least some of the image bearing members, and capable of varying transfer pressure between the image bearing members and the transfer body in contact with said image bearing members.

5 Claims, 8 Drawing Sheets

U.S. PATENT DOCUMENTS

| | | | | |
|---|---|---|---|---|
| 6,990,309 | B2 | 1/2006 | Kayahara et al. | |
| 7,003,238 | B2 | 2/2006 | Yoshida et al. | |
| 7,162,170 | B2 | 1/2007 | Kayahara | |
| 7,184,678 | B2 | 2/2007 | Ishii et al. | |
| 2003/0210932 | A1* | 11/2003 | Koide et al. | 399/302 |
| 2003/0223784 | A1* | 12/2003 | Yamanaka et al. | 399/299 |
| 2004/0131398 | A1* | 7/2004 | Omata et al. | 399/309 |
| 2005/0013636 | A1 | 1/2005 | Sawai et al. | |
| 2005/0078991 | A1 | 4/2005 | Kimura et al. | |
| 2005/0185991 | A1* | 8/2005 | Iwakura et al. | 399/299 |
| 2006/0140665 | A1 | 6/2006 | Hashimoto et al. | |
| 2007/0059054 | A1* | 3/2007 | Furukawa | 399/302 |
| 2007/0116496 | A1* | 5/2007 | Morimoto et al. | 399/299 |
| 2007/0286628 | A1 | 12/2007 | Kayahara et al. | |

FOREIGN PATENT DOCUMENTS

| | | |
|---|---|---|
| JP | 2002-14515 | 1/2002 |
| JP | 2005-128230 | 5/2005 |

OTHER PUBLICATIONS

U.S. Appl. No. 12/049,838, filed Mar. 17, 2008, Senoh, et al.

* cited by examiner

TRANSFER DEVICE AND IMAGE FORMING APPARATUS

CROSS-REFERENCE TO RELATED APPLICATIONS

This application is based upon and claims the benefit of priority from Japanese Patent Application No. 2006-160212, filed Jun. 8, 2006, the entire contents of which are incorporated herein by reference.

BACKGROUND OF THE INVENTION

1. Field of the Invention

The present invention relates to a transfer device mounted in an image forming apparatus, such as a copying machine, a printer, or a facsimile apparatus, which uses an electrophotographic technology.

2. Description of the Related Art

Currently, a single-drum type image forming apparatus and a tandem type image forming apparatus are known. The single-drum type image forming apparatus includes a single image bearing member (i.e., photoreceptor drum), whereas the tandem type image forming apparatus includes two or more image bearing members. Since the tandem type image forming apparatus provides high productivity in comparison with the single-drum type image forming apparatus, the tandem type has become widespread in recent years.

Examples of the tandem type image forming apparatus include one that directly transfers a toner image from an image bearing member onto a transfer material on a transfer conveying body, and one that first transfers a toner image from an image bearing member onto an intermediate transfer body and finally transfers the toner image onto the transfer material. Each type is configured such that some of the image bearing members can be separated from the transfer conveying body or intermediate transfer body respectively. This is because constant contact of each image bearing member with the transfer conveying body or intermediate transfer body may lead to scratching or wear after long use and, therefore, it is necessary that image bearing members for colors not involved in an image formation be separated from the transfer body or the like in order to prolong the life of the components. Generally, such a separation is switched between a monochrome mode and full-color mode. For example, in the case of an apparatus in which four image stations are arranged in tandem, image forming units for the four generally-used colors (black, cyan, magenta, and yellow) are designed such that only the image bearing member for black and the transfer body are brought into contact with each other in monochrome mode whereas image bearing members for all the colors and the transfer body are brought into contact with each other in full-color mode (refer to Japanese Patent Application Laid-Open No. H9-146383).

Meanwhile, such a tandem type image forming apparatus suffers from image defects caused by banding. Banding occurs when a toner image is blurred or a dot image is distorted due to unstable rotating speed of the transfer body or an image bearing member during the formation of toner images on the image bearing members or during the transfer of toners from the image bearing members to the transfer body.

The causes of banding with respect to components involved in the image transfer reside in unstable rotating speed of the transfer body. Factors contributing to unstable rotating speed of the transfer body may be shock from starting or stopping of a rotating body provided in the apparatus, shock from the operation of a contact/separation member, shock from a transfer material, such as paper, entering or exiting the transfer body, etc.

In order to prevent image defects caused by banding, a conventional technique increases electrostatic attraction between an image bearing member and the transfer body, thereby making the speed of the transfer body less susceptible to disturbance.

An example of such a technique is described in Japanese Patent Application Laid-Open No.2005-128230. The application discloses an image forming apparatus including: a latent image forming unit that forms an electrostatic latent image on an image bearing member; a development unit that develops the electrostatic latent image into a toner image; a primary transfer unit that transfers the toner image to an intermediate transfer body; and a secondary transfer unit that transfers the toner image, transferred to the intermediate transfer body, to a recording medium, and the apparatus includes a member for a contact/separation operation or driving/stopping operation, which is performed in the non-image formation area on the intermediate transfer body or in an area of the image bearing member, which area corresponds to the non-image formation area. This image forming apparatus sets primary transfer bias to high while the position on the intermediate transfer body, where the separation/contact operation or driving/stopping operation is performed, is passing through a primary transfer position.

However, the inventors of the present invention discovered that such countermeasures are not enough to prevent image defects caused by banding, and examined the factors contributing to banding in detail. It has been found that more defects arose while the image bearing members and the transfer body are partially separated from each other. Further analysis revealed that a decrease in electrostatic attraction in the area where the image bearing member and the transfer body are separated results in a decrease in the overall electrostatic attraction between the image bearing members and the transfer body. This increases instability of the transfer body.

In order to avoid such defects, transfer bias is further increased using conventional techniques. This reduces banding. However, the excessively high transfer bias results in inconveniences such as formation of an abnormal discharge image, a reverse transfer image, etc., and thus desirable image quality cannot be obtained.

SUMMARY OF THE INVENTION

It is an object of the present invention to at least partially solve the problems in the conventional technology.

According to one aspect of the present invention, a transfer device is provided for an image forming apparatus designed such that toner images formed on a plurality of image bearing members are transferred one over another on a transfer body disposed in contact with each of the image bearing members with predetermined pressure and thus a toner image in two or more colors is formed on the transfer body. The transfer device includes a pressure varying mechanism capable of separating the transfer body from at least some of the image bearing members, and capable of varying transfer pressure between the image bearing members and the transfer body in contact with said image bearing members.

According to another aspect of the present invention, an image forming apparatus includes the transfer device according to the present invention.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Preferred embodiments of the present invention will be described in detail with reference to the attached drawings.

The description is provided below on an electrophotographic apparatus of a tandem type intermediate transfer system, in which photoreceptors are used as image bearing members and an intermediate transfer body as a transfer body.

Figure 1:
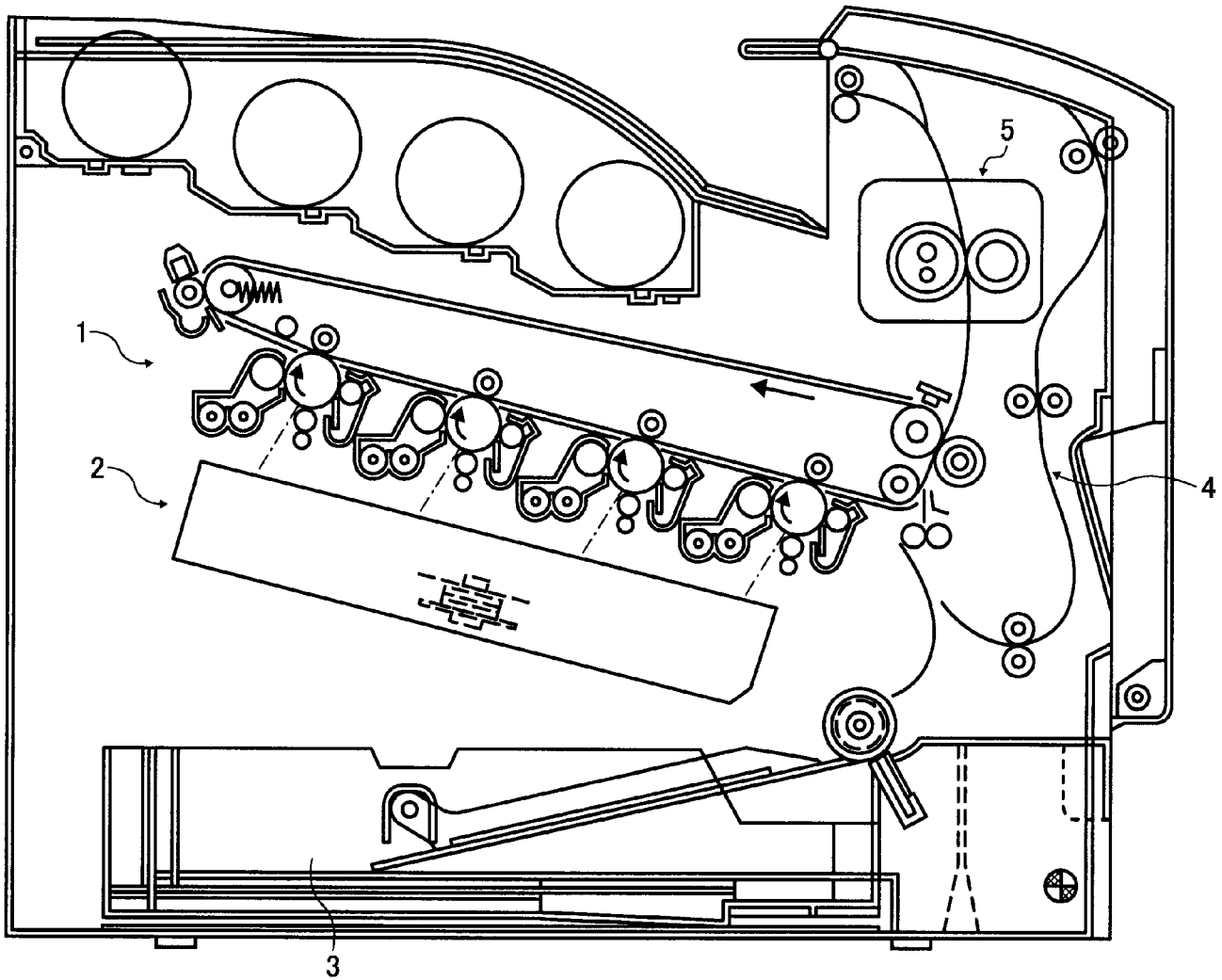
FIG. 1 is a schematic view of an electrophotographic apparatus of a tandem type intermediate transfer system as an application example of the present invention.

FIG. 1 is a schematic view of the electrophotographic apparatus of the tandem type intermediate transfer system to which the present invention is applied.

The electrophotographic apparatus includes: a tandem image forming unit 1, which has four image stations; a writing optical device 2, which writes optical image information onto the image bearing members of the corresponding image stations; a paper feed table 3, which supports the entire apparatus at the bottom and feeds a transfer material to the image forming unit; a conveying/inverting device 4, which conveys and inverts a fed transfer material; and a fixing device 5, which fixes a toner image transferred to a transfer material.

Figure 2:
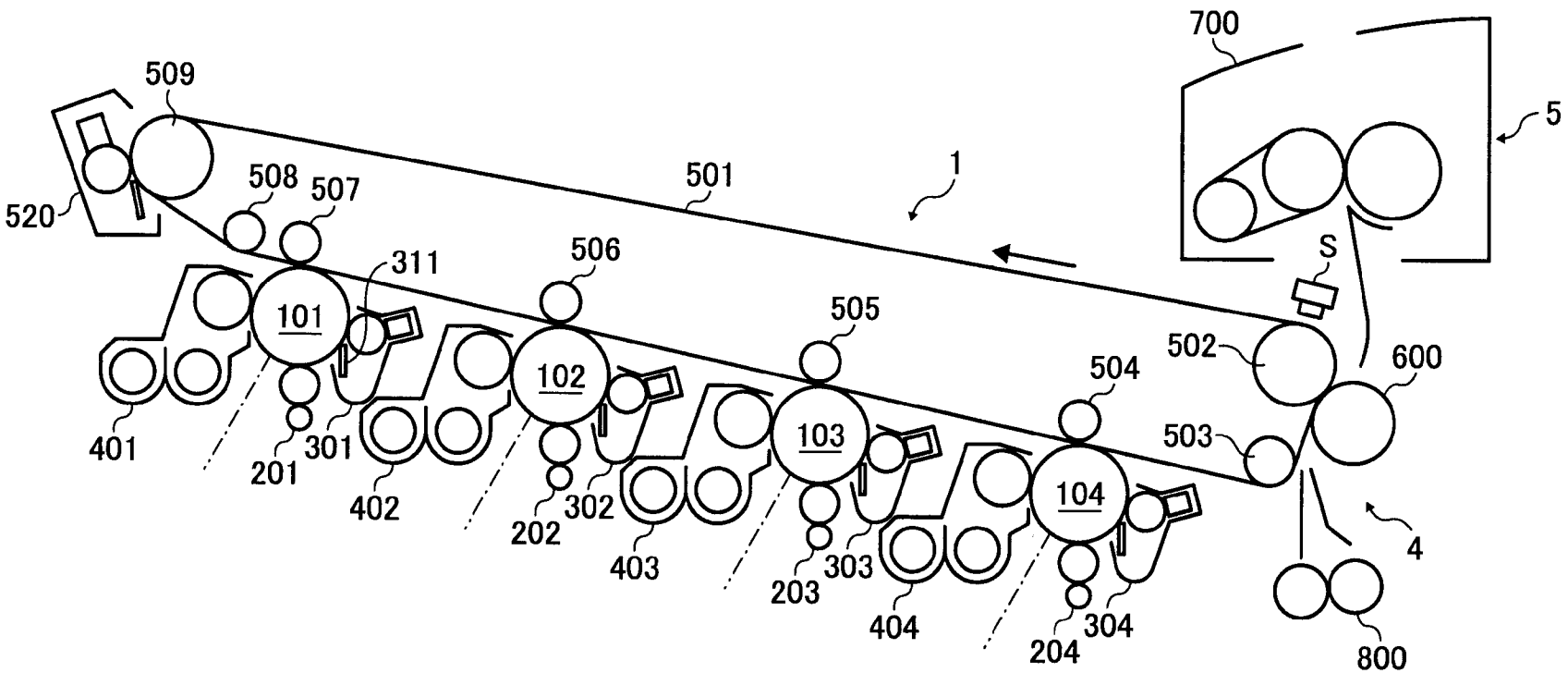
FIG. 2 is an enlarged view of an image forming unit shown in FIG. 1.

FIG. 2 is an enlarged view of the image forming unit 1 of FIG. 1. The tandem type image forming unit 1 has an intermediate transfer body 501 in the form of an endless belt, which is held taut in the middle of the unit. The intermediate transfer body 501 is formed from a single layer or multiple layers of rubber, resin, or the like.

The intermediate transfer body 501 is stretched around a secondary transfer bias roller 502 and support rollers 503, 508, and 509. In the example shown in the drawing, the intermediate transfer body 501 is rotatable counterclockwise. A secondary transfer unit 600 is disposed opposite to the secondary transfer bias roller 502 with the intermediate transfer body 501 between them.

Using a secondary transfer electric field generating unit (not shown), the secondary transfer bias roller 502 generates an electric field of the same polarity as the toner. Electrostatic repulsion secondarily transfers the toner onto a transfer material.

Disposed on the left side of the support roller 509 is an intermediate transfer body cleaner 520 which removes the toner remaining on the intermediate transfer body 501 after image transfer.

Primary transfer bias rollers 504, 505, 506, and 507 which generate an electric field for primary transfer are disposed on the inside of the intermediate transfer body 501 between the support rollers 503 and 508 so as to be contactable with the intermediate transfer body 501 and separable therefrom.

Disposed opposite to the primary transfer bias rollers 504, 505, 506, and 507 with the intermediate transfer body 501 between them are, in order in the direction of conveyance of the intermediate transfer body 501, photoreceptors 101, 102, 103, and 104 for yellow, cyan, magenta, and black, respectively, which are arranged sidewise. The tandem type image forming unit 1 is configured in this manner.

Disposed around the photoreceptors 101, 102, 103, and 104 are photoreceptor charging units 201, 202, 203, and 204, photoreceptor cleaning units 301, 302, 303, and 304, and developing units 401, 402, 403, and 404 respectively.

The photoreceptors are subject to writing exposure from the optical device 2 emitting laser beams to the photoreceptors from positions between the photoreceptor charging units (i.e., charging rollers) 201 to 204 and corresponding developing units 401 to 404.

Below the secondary transfer unit 600 are registration rollers 800 for feeding a recording medium P to the secondary transfer unit. Above the secondary transfer unit 600 is a fixing unit 700 for fixing a toner image on a recording medium.

Next, detailed conditions for a transfer device according to the embodiment of the present invention will be described.

An organic photoreceptor (OPC) is used as each of the photoreceptor drums 101 to 104. The photoreceptors are uniformly charged to −200 to −2000 V by the corresponding charging rollers 201 to 204. The photoreceptors are then subject to optical writing by being irradiated with laser beams corresponding to the images on a document, whereby corresponding electrostatic latent images are formed on them. Negatively charged toner is used for negative-positive development so that toner images are formed on the corresponding photoreceptors 101 to 104.

In the cleaning unit for each of the corresponding photoreceptors 101 to 104, a blade member 311 serving as a cleaning member made of urethane rubber is provided.

An intermediate transfer belt formed from a thermosetting resin with a thickness of 0.10 mm, a width of 246 mm, and an internal circumference of 796 mm is adopted as the intermediate transfer body 501. The speed of movement of the intermediate transfer belt 501 is set to 155 mm/sec. The volume resistivity of the entire intermediate transfer belt formed from such a material was found to be in the range of $10^7$ to $10^{12}$ Ωcm by measurement. Each volume resistivity was measured using a measuring method specified in Japanese Industrial Standard (JIS) K6911, and, the intermediate transfer belt was measured while a voltage of 100 V was applied to the belt for 10 seconds. The surface resistivity of the intermediate transfer belt 501 was 109 to 1014 Ω/□ as the result of measurement with resistance measuring device "Hiresta IP" manufactured by Mitsubishi Petrochemical Co., Ltd. In lieu of the aforesaid resistance measuring device, an alternative surface resistivity measuring method specified in JIS K6911 can be used to gauge surface resistivity. As for the support rollers 502, 503, and 509, metal or rubber rollers with a diameter of 12 mm to 26 mm are adopted. The width of each roller is set to 236 mm in order to prevent the intermediate transfer belt 501 from meandering.

Urethane foam rubber rollers are used as the primary transfer rollers 504 to 507. A spring with 0.1 N to 10 N is used to apply pressure to each of the primary transfer rollers 504 to 507.

An electric field of approximately 0 to 100 μA current and approximately 0 to −4 kV voltage is applied to a high voltage power source for secondary transfer of negatively charged toner.

A separating operation will now be described.

Despite the recent spread of color image forming apparatuses, offices mostly use monochrome documents. Forming monochrome images based on a monochrome document requires only a black photoreceptor. Therefore, in terms of unit longevity, it is most desirable to disengage other color photoreceptors.

For this reason, the image forming apparatus is designed such that the intermediate transfer body 501 is separable from some or all of the photoreceptors 101 to 104.

Figure 3A:
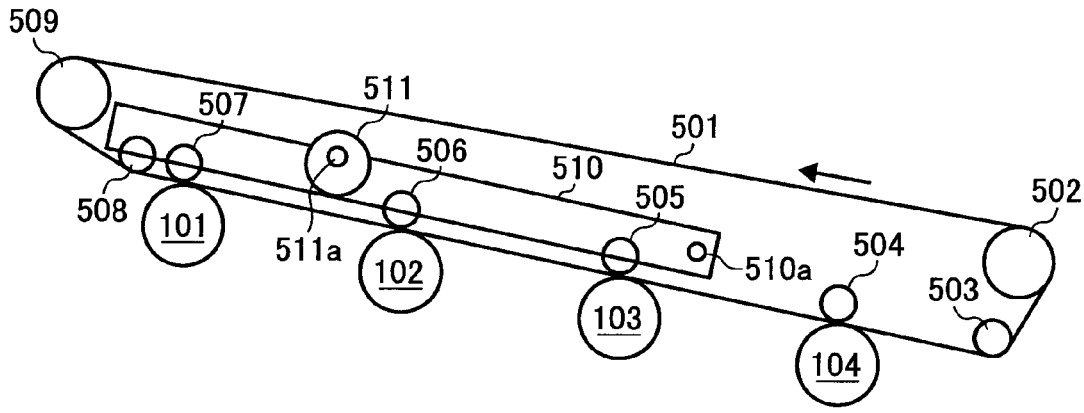
FIGS. 3A and 3B illustrate the operation of a pressure varying mechanism.
Figure 3B:
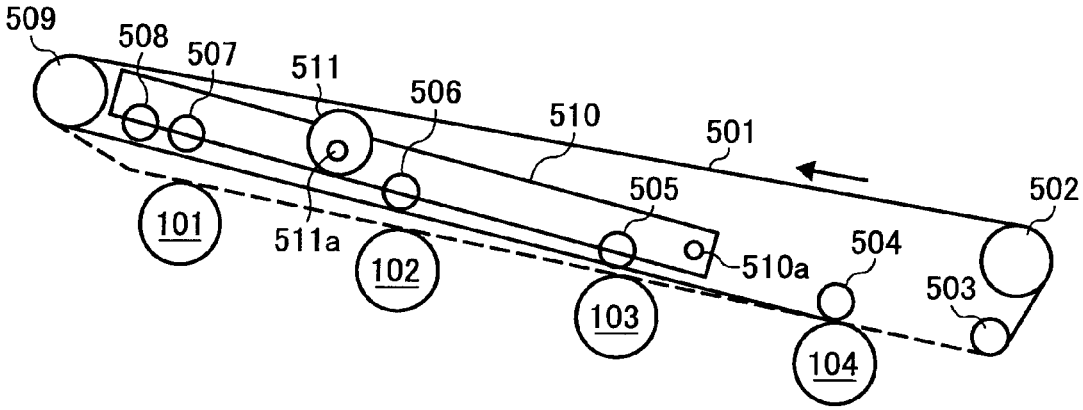

The transfer rollers 505, 506, and 507 for yellow, cyan, magenta, and the roller 508 are supported by a contact/separation unit (pressure-varying mechanism) 510 so as to be freely rotatable. The contact/separation unit 510 is vertically rotatable about a shaft 510*a* disposed in the right-hand portion of the contact separation unit 510. As shown in FIGS. 3A and 3B, the intermediate transfer body 501 can be separated from the photoreceptors by the rotation of the contact/separation unit 510. The separating operation is controlled by a rotating cam (pressure-varying mechanism) 511, an eccentricity shaft 511a of which is supported by the main body of the device, and an elastic member (another pressure-varying mechanism) returning the contact/separation unit 510 upward. The cam 511, driven by a motor (not shown), depresses a specific part of the contact/separation unit 510, thereby pressing the intermediate transfer body 501 against the photoreceptors, as shown in FIG. 3A, or returns the contact/separation unit 510 upward with the use of the resilient force of an elastic body (not shown), thereby separating the intermediate transfer body from the photoreceptors, as shown in FIG. 3B.

Next, a description is given of the configuration of the transfer device according to the embodiment of the invention, which includes the pressure-varying mechanisms.

In order to prevent image defects caused by banding, a countermeasure taken in the conventional techniques described above increases transfer bias, but this greatly affects images.

To overcome such a drawback, the present invention proposes a technique for increasing transfer pressure, instead of increasing electrostatic attraction by an increase in transfer bias.

Figure 4:
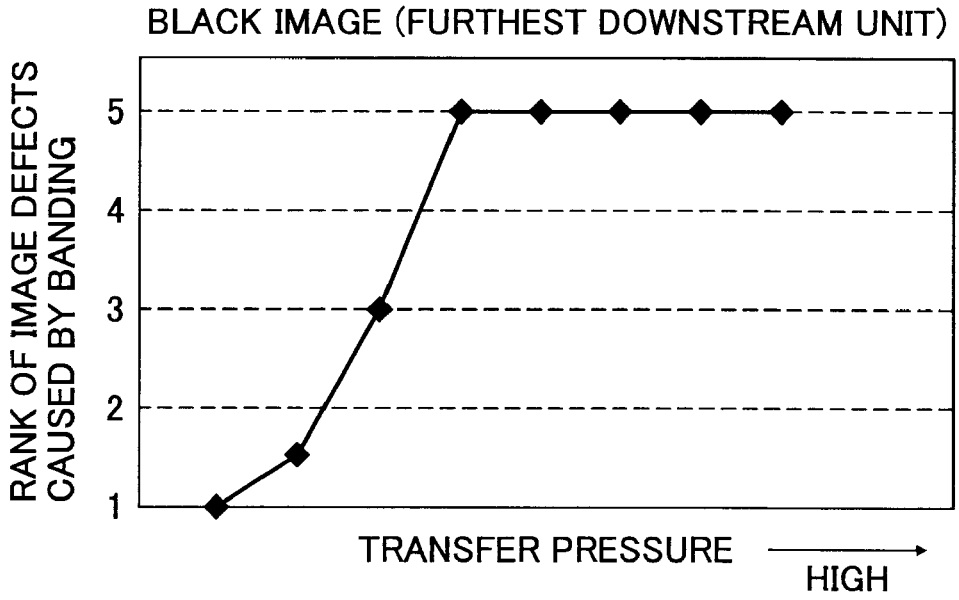
FIG. 4 is a graph showing the relation between transfer pressure and image defects caused by banding.

The present inventors examined the relation between image defects due to banding and transfer pressure, by using the black image station (i.e., black transfer roller 504) located furthest downstream in the direction of movement of the intermediate transfer body 510, and by applying higher transfer pressure than that applied in the conventional technique. It was revealed that as the transfer pressure increased, an image defect was less likely to occur and with pressure of a certain value or larger no image defects were generated, as shown in FIG. 4. This is because the increased transfer pressure makes it less likely that the speed of the intermediate transfer body change. Referring to the graph shown in FIG. 4, the horizontal axis represents transfer pressure whereas the vertical axis represents image defects caused by banding (e.g., transfer misalignment and dot displacement). The image defects were ranked (i.e., rank 1 indicates the highest quality and rank 5 the lowest quality).

However, the inventors also discovered that an excessive increase in transfer pressure causes void, which is another defect. Void occurs when part of an image remains on an image bearing member and fails to be transferred to a transfer body. This is particularly likely to occur in images formed from extremely thin lines.

Figure 5:
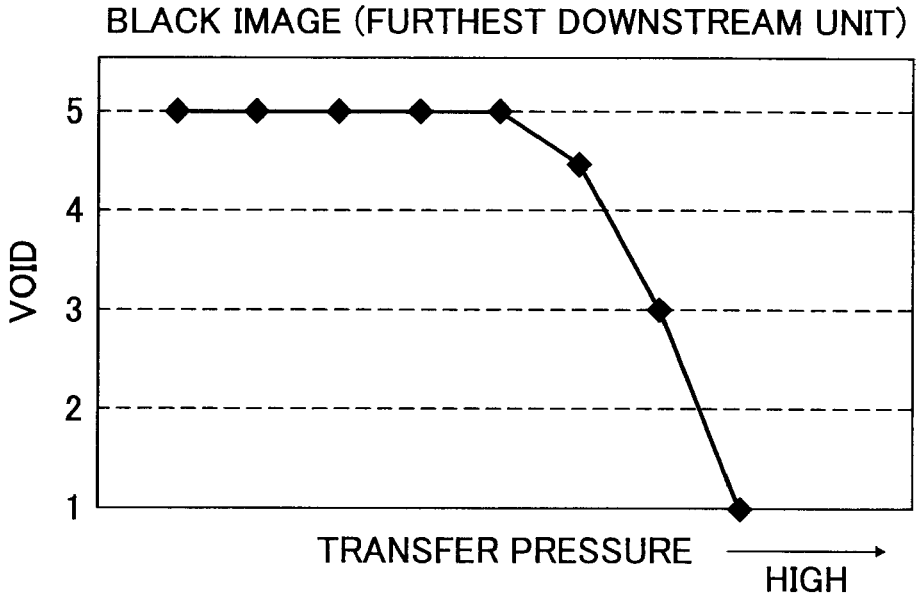
FIG. 5 is a graph showing the results of the analysis of the relation between transfer pressure and the degree of void, determined using a black image station located furthest downstream in the direction of movement of an intermediate transfer body.

Using the black image station positioned furthest downstream in the direction of movement of the intermediate transfer body 501, the inventors examined and analyzed the relation between the transfer pressure and the degree of void. FIG. 5 illustrates the result of the analysis, in which transfer pressure of a certain value or larger results in a significant occurrence of void.

Figure 6:
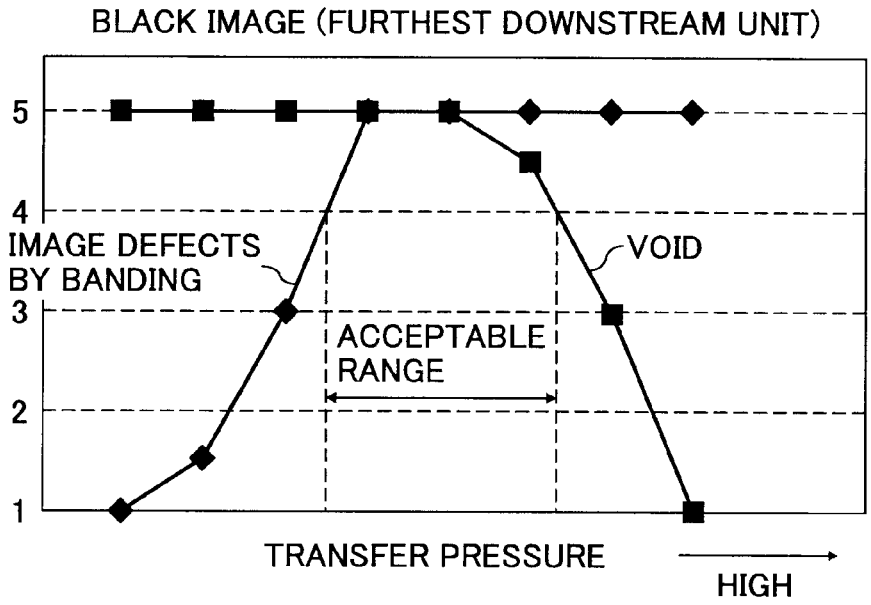
FIG. 6 is a graph showing a range where degrees of both the banding and the void are acceptable as shown in FIGS. 4 and 5.

After considering a combination of the results illustrated in FIGS. 4 and 5, the inventors confirmed a range in which both results are acceptable, as shown in FIG. 6. Given that rank four or above in the evaluation of image defects indicates a acceptable level at which image defects are inconspicuous, setting the transfer pressure to the acceptable range between the broken lines is effective in preventing both defects.

Applying transfer pressure in the acceptable range, various images were sampled and evaluated. The results revealed that void still occurred in the color image station, other than the black image station, especially the one located furthest upstream in the direction of movement of the intermediate transfer body 501 (in this embodiment, the yellow image station). To analyze this, the inventors examined degrees of void of a yellow image on the intermediate transfer body 501. It was revealed that, immediately after the transfer of the yellow toner image to the intermediate transfer body 501 from the yellow photoreceptor, there was no void in the yellow toner image, but void worsened each time the yellow toner image passed through downstream transfer units (cyan, magenta, and black). The inventors discovered that the void resulted from a reverse transfer phenomenon, in which the yellow toner image was moved to subsequent photoreceptors from the intermediate transfer body 501 each time the image was subjected to pressure in the transfer unit located downstream of the yellow one.

Figure 7:
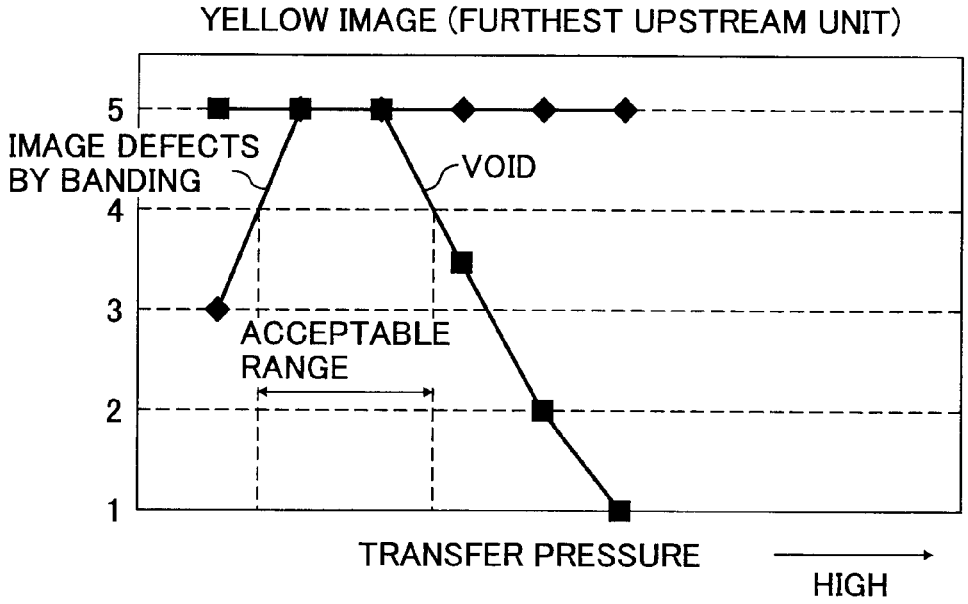
FIG. 7 is a graph showing the results of the examination of the relation between transfer pressure in a yellow transfer unit, void, and image defects caused by banding.

Therefore, the inventors examined the relation between pressure on the yellow transfer unit, image defects caused by banding, and the degree of void. FIG. 7 illustrates the result of the examination. According to FIG. 7, during the formation of the yellow image, all the photoreceptors were in contact with the intermediate transfer body 501 so that electrostatic attraction was strong and banding was less likely to occur even though transfer pressure was low. However, void easily occurred even with low transfer pressure. The behavior of yellow toner image formation was different from that of black image formation. The inventors concluded that the optimum transfer pressure for a yellow toner image was much lower.

According to the results described above, the transfer pressure exerted for color image formation is best set in the range shown in FIG. 7 whereas transfer pressure exerted for monochrome image formation is best set in the range shown in FIG. 6. Accordingly, the present invention prevents both void and image defects caused by banding.

Meanwhile, in order to alter transfer pressure according to an image formation mode, it is desirable to use an existing mechanism. In the present embodiment, drive force to alter the transfer pressure on the black transfer unit (primary transfer bias roller 504) is transmitted from a drive mechanism used for separating the intermediate transfer body 501 from the photoreceptors for the period of monochrome image formation (refer to FIGS. 8A and 8B).

The primary transfer bias roller 504 for black image formation is kept depressed downward by a pressure spring (pressure-varying mechanism) 514.

Figure 8A:
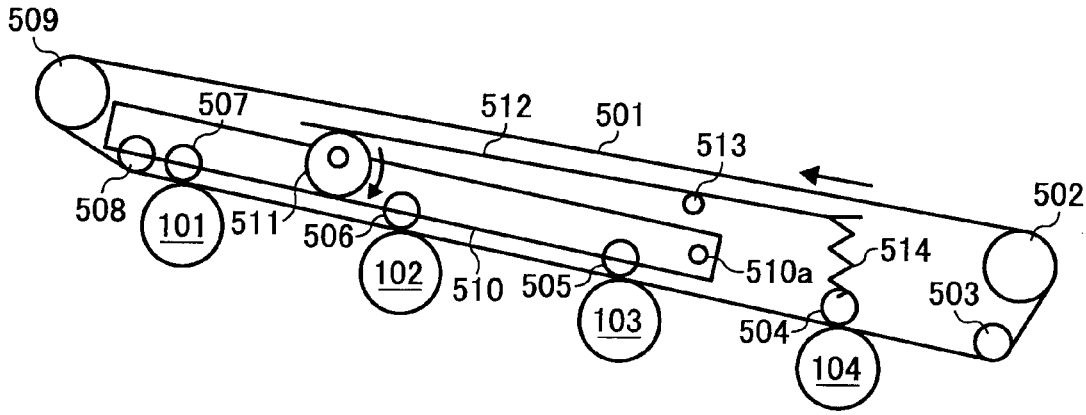
FIGS. 8A and 8B are views illustrating the operation of a pressure-varying mechanism.
Figure 8B:
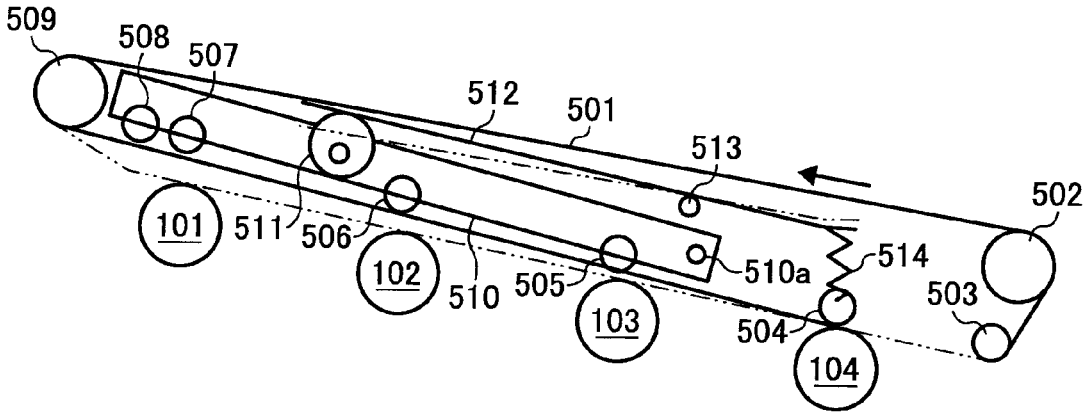

In addition, disposed above the cam 511 is a transmission member (pressure-varying mechanism) 512 configured so as to be vertically movable about a support point 513 in a seesaw manner. As shown in FIG. 8B, elevating the left end of the transmission member 512 by the cam 511 causes its right end to shorten the pressure spring 514 of the black transfer unit. Also as shown in FIG. 8A, lowering the left end causes the right end to lengthen the pressure spring 514. This makes it possible to maintain or vary the pressure exerted by the primary transfer bias roller 504 on the photoreceptor 104.

When a monochrome image is formed, the cam 511 rotates in the direction of the arrow in order to separate the color photoreceptors 101 to 103 from the intermediate transfer body 501. When the cam 511 has reached the highest position as shown in FIG. 8B, the separating operation ends. At this time, the transmission member 512 disposed on the cam 511 is vertically rotated about the support point 513 and shortens the pressure spring 514 of the black transfer unit. Before the spring shortens, pressure in the range shown in FIG. 7 is set. After the spring shortens, pressure in the range shown in FIG. 6 is set. This obviates the need for an additional drive unit to change the length of the spring of the black transfer unit, and makes the pressure applied to the black transfer unit different in the case of color and monochrome image formation.

The foregoing description is just one example, and shortening the spring by using force from another drive unit is also effective in the present invention.

In addition, the above description specifies the way in which the photoreceptors for yellow, cyan, and magenta are separated from the intermediate transfer body. Alternatively, however, either one or more of the photoreceptors may be separated from the intermediate transfer body.

Moreover, in the foregoing the number of photoreceptors is four, but the present invention will sufficiently apply as long as the number of photoreceptors is greater than one.

Figure 9A:
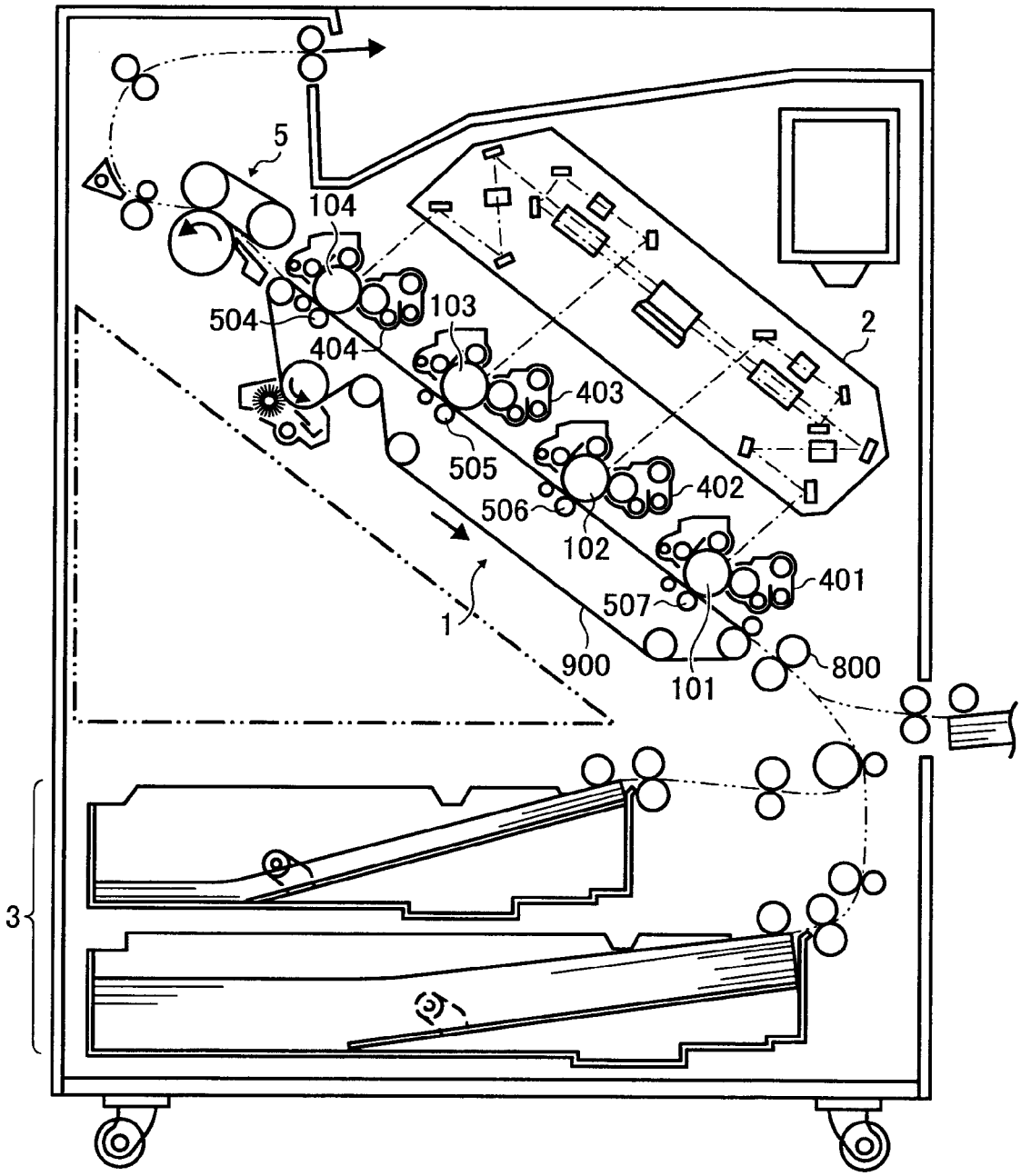
FIGS. 9A and 9B are views illustrating the configuration of an electrophotographic apparatus in which a transfer body is a transfer material (e.g., paper) on a transfer conveying body.
Figure 9B:
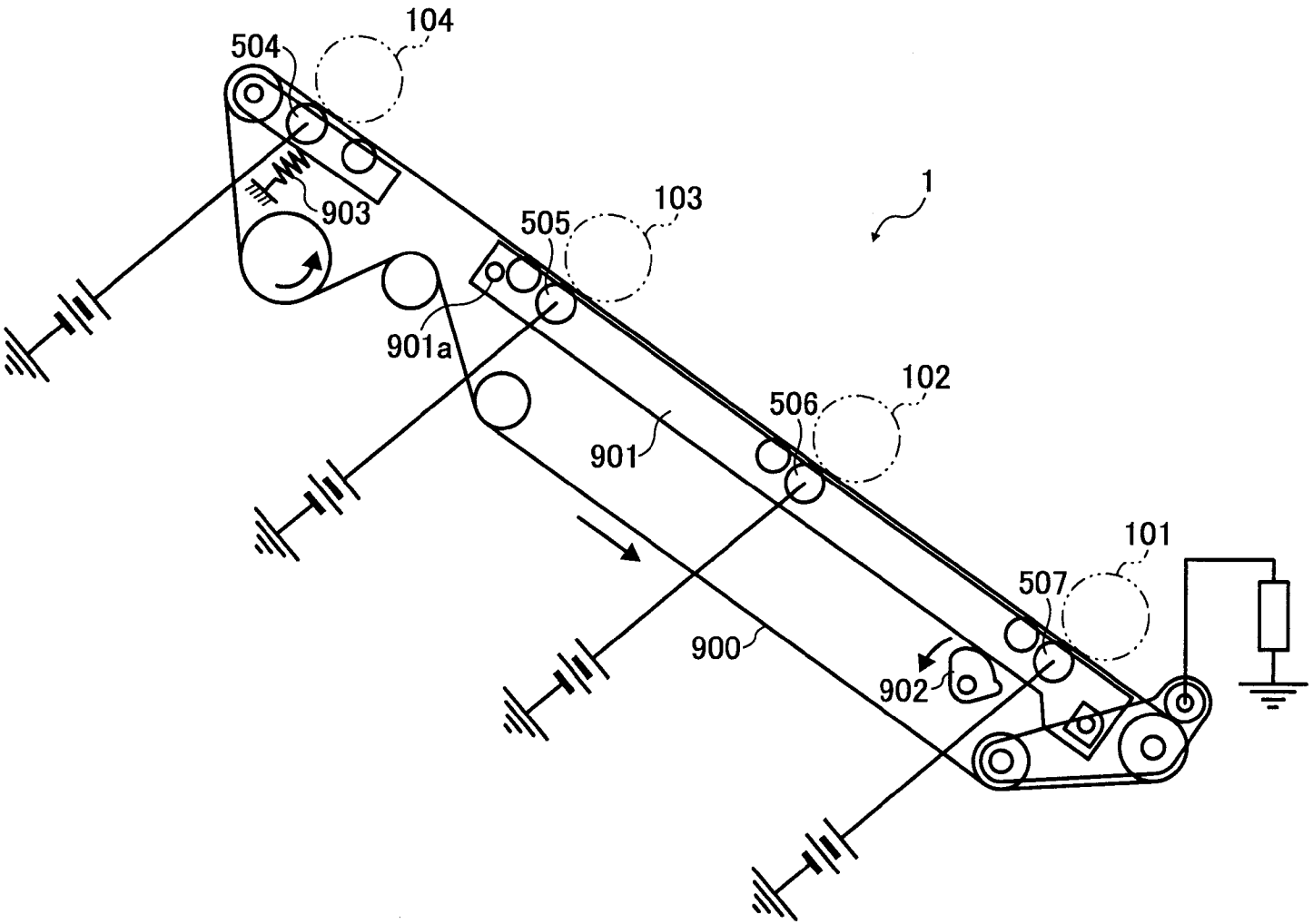

Next, reference is made to FIGS. 9A and 9B, which are views illustrating the configuration of an electrophotographic apparatus in which the transfer body is a transfer material (e.g., paper) on a transfer conveying body.

Identical reference numbers are used for components identical to those of the foregoing embodiment in which the transfer body is the intermediate transfer body.

The electrophotographic apparatus includes: a tandem type image forming unit 1, which has four image stations; a writing optical device 2, which optically writes image information onto an image bearing member of each station; a paper feed table 3, which supports the entire apparatus at the bottom and feeds a transfer material to the image forming unit; and a fixing device 5, which fixes a toner image transferred to the transfer material.

The tandem type image forming unit 1 has a transfer body 900 in the form of an endless belt, which is held taut in the middle of the unit. The transfer body 900 is formed from a single layer or multiple layers of rubber, resin, or the like.

The transfer body 900 is stretched by a plurality of support rollers, and rotatable counterclockwise in the exemplified drawing.

Disposed opposite to transfer bias rollers 504, 505, 506, and 507 with the transfer body 900 between them are, in order in the direction of conveyance, the photoreceptors 104, 103, 102, and 101 for yellow, cyan, magenta, and black respectively, which are arranged sidewise. The tandem image forming unit 1 is configured as described above.

Disposed around each of the photoreceptors 101 to 104 are a corresponding photoreceptor charging unit, a corresponding photoreceptor cleaning unit, and a corresponding one of developing units 401 to 404.

The photoreceptors are subject to writing exposure by means of an optical device 2 emitting laser beams onto the photoreceptors from positions between the photoreceptor charging units (i.e., charging rollers) and corresponding developing units 401 and 404.

In addition, registration rollers 800 are disposed for feeding a recording medium P to transfer units. Downstream of the transfer units is provided a fixing device 5 that fixes a toner image on the recording medium.

The transfer bias rollers 505, 506, and 507 but not the bias roller 504 for black are supported by a contact/separation unit 901 (equivalent to the contact/separation unit 510 in the above-described embodiment) so as to be freely rotatable. The contact/separation unit 901 is supported by a shaft 901a so as to be freely rotatable in a vertical direction. The contact/separation unit 901 is configured so that a cam 902 and a reset coil can move the transfer bias rollers 505 to 507 toward the corresponding photoreceptors or retract them.

The bias roller 504 for black is pressed against the corresponding photoreceptor 104 by a spring 903.

The spring 903 depresses or releases the bias roller 504 by the action of the cam 902 via a transmission member equivalent to the transmission member 512 shown in FIGS. 8A and 8B. This eliminates the need for any additional drive to change the length of the spring of the black transfer unit, and makes the pressure applied to the black transfer unit different in the case of color image formation and monochrome image formation.

Setting transfer pressure to a predetermined range in order to form a color image and setting transfer pressure to another predetermined range in order to form a black image prevent void as well as image defects caused by banding. Specifically, increasing transfer pressure in a monochrome mode in which electrostatic attraction is weak prevents image defects caused by banding; on the other hand, setting transfer pressure of a transfer roller on the image bearing member for black to a different predetermined range prevents void as well as image defects caused by banding.

Further, this invention exhibits such an effect that the existing drive unit suffices to vary transfer pressure and, therefore, eliminates the need for any additional drive force.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claim is:

1. A transfer device provided for an image forming apparatus designed such that toner images formed on a plurality of image bearing members are transferred one over another on a transfer body disposed in contact with each of the image bearing members with predetermined pressure and thus a toner image in two or more colors is formed on the transfer body, the transfer device comprising:

a first pressure varying mechanism configured to move a first transfer unit away from a first image bearing member of the plurality of image bearing members so as to separate the transfer body from the first image bearing member, wherein the first transfer unit is arranged on an opposite side of the transfer body from the first image bearing member;

a second pressure varying mechanism configured to vary a transfer pressure between a second image bearing member of the plurality of image bearing members and the transfer body via a second transfer unit, wherein the second transfer unit is arranged on an opposite side of the transfer body from the second image bearing member; and a transmission member that mechanically links the first pressure varying mechanism and the second pressure varying mechanism such that the second pressure varying mechanism increases the transfer pressure between the second image bearing member and the transfer body when the first pressure varying mechanism moves the first transfer unit away from the first image bearing member.

2. A device according to claim 1, wherein the transfer body is an intermediate transfer body.

3. A device according to claim 1, wherein the transfer body is a transfer material on a transfer conveying body used for conveying the transfer material to a transfer position.

4. A device according to claim 1, wherein the transfer pressure is varied using drive force from a contact/separation unit configured to bring the transfer body into contact with the image bearing members and configured to separate the transfer body from the image bearing members.

5. An image forming apparatus including the transfer device according to claim 1.

* * * * *